US008721367B2

(12) United States Patent
Matsumoto et al.

(10) Patent No.: US 8,721,367 B2
(45) Date of Patent: May 13, 2014

(54) FUSE UNIT

(75) Inventors: Yusuke Matsumoto, Makinohara (JP); Toshiko Masuda, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/577,760

(22) PCT Filed: Feb. 4, 2011

(86) PCT No.: PCT/JP2011/052445

§ 371 (c)(1),
(2), (4) Date: Aug. 8, 2012

(87) PCT Pub. No.: WO2011/099432

PCT Pub. Date: Aug. 18, 2011

(65) Prior Publication Data

US 2012/0302098 A1 Nov. 29, 2012

(30) Foreign Application Priority Data

Feb. 10, 2010 (JP) ..... 2010-027422

(51) Int. Cl.
*H01R 13/68* (2011.01)

(52) U.S. Cl.
USPC ..... 439/620.26

(58) Field of Classification Search
USPC ..... 439/620.26, 522; 174/50; 337/189, 161, 337/295, 166, 142, 290
See application file for complete search history.

(56) References Cited

U.S. PATENT DOCUMENTS 5,645,448 A * 7/1997 Hill ..... 439/522
5,805,047 A * 9/1998 De Villeroche et al. ..... 337/290
6,294,978 B1 * 9/2001 Endo et al. ..... 337/166
6,509,824 B2 * 1/2003 Inaba et al. ..... 337/295
6,512,443 B1 * 1/2003 Matsumura et al. ..... 337/189
6,759,938 B2 * 7/2004 Matsumura et al. ..... 337/161
6,806,421 B2 * 10/2004 Matsumura ..... 174/50
7,176,780 B2 * 2/2007 Iwata ..... 337/188
7,663,465 B2 * 2/2010 Matsumoto et al. ..... 337/187
2001/0011939 A1 * 8/2001 Inaba et al. ..... 337/265

FOREIGN PATENT DOCUMENTS

JP 11040041 A 2/1999
JP 2001273848 A 10/2001
JP 2001297683 A 10/2001
JP 2007087823 A 4/2007

OTHER PUBLICATIONS

International Search Report dated Mar. 8, 2011 issued in International Application No. PCT/JP2011/052445 (PCT/ISA/210).
Written Opinion dated Mar. 8, 2011 issued in International Application No. PCT/JP2011/052445 (PCT/ISA/237).

* cited by examiner

*Primary Examiner* — Alexander Gilman
(74) *Attorney, Agent, or Firm* — Sughrue Mion, PLLC

(57) ABSTRACT

A fuse unit includes a fuse element and an insulative resin part. The fuse element includes a power supply connecting part fixed to a battery post of a battery so as to receive power supply and arranged along an upper surface of the battery, a terminal connecting part to which a terminal is connected, and a fusible part provided between the power supply connecting part and the terminal connecting part. The insulative resin part is arranged on outer surface of the fuse element. The fuse element is bent upwards at a position between the power supply connecting part and the terminal connecting part. The terminal connecting part is arranged at a position above the upper surface of the battery and along a side surface direction of the battery.

4 Claims, 13 Drawing Sheets

FUSE UNIT

TECHNICAL FIELD

This invention is related to a fuse unit which is directly attached to a battery.

BACKGROUND ART

For example, a fuse unit which is directly attached to a battery loaded on a vehicle has a shape which is bent almost at a right angle in consideration of a setting space or the like. One conventional example of this kind of fuse unit is explained based on FIGS. 10 to 14.

As shown in FIGS. 10 to 12, a battery post 51 is protruded from the upper surface of a battery 50 which is loaded in a vehicle. A fuse unit 60 is fixed to the battery post 51 via a battery connecting terminal 52.

The fuse unit 60 is provided with a fuse element 61 and an insulative resin part 70 which is provided outside the fuse element 61 with insertion molding. The fuse element 61 is formed of a busbar which is a conductive metal plate. The fuse element 61 has a power supply connecting part 62 which is fixed to the battery post 51 via the battery connecting terminal 52, first terminal connecting parts 63 and second terminal connecting parts 64 which are connected to terminals not shown in the figures, first terminal fusible parts 65 which respectively intervene between the power supply connecting part 62 and the first terminal connecting parts 63, and second terminal fusible parts 66 which respectively intervene between the electric supply connecting part 62 and the second terminal connecting parts 64.

The power supply connecting part 62 receives power from the battery 50 via the battery connecting terminal 52. The first and second terminal connecting parts 63 and 64 have bolts 67 which are fixed with the insulative resin part 70, and the terminals (not shown in the figures) are fixed using the bolts 67.

The fuse element 61 is bent between the first terminal connecting parts 63 and the second terminal fusible parts 66. Thereby, the power supply connecting part 62, the first terminal connecting parts 63 and the first terminal fusible parts 65 are arranged in the overhang direction (arrow X direction) along the upper surface 50*a* of the battery 50, and the second terminal fusible parts 66 and the second terminal connecting parts 64 are arranged in the direction of the side surface of the battery (arrow Y direction) along the side surface 50*b* of the battery 50.

The insulative resin part 70 generally covers those parts other than the electric supply connecting part 62, the first and second terminal connecting parts 63 and 64, the first and second terminal fusible parts 65 and 66. Fusible part windows 70*a* are respectively formed in the insulative resin part 70 so that the first terminal fusible parts 65 and the second terminal fusible parts 66 are enclosed. Each of the fusible part windows 70*a* is closed by a transparent fusible part cover 71. In the insulative resin part 70, electric wire holding parts 70*b* are formed at the bottom of the second terminal connecting parts 64, respectively.

Next, a method of manufacturing the fuse unit 60 of the above-mentioned structure is explained briefly.

First, as shown in FIG. 13, the fuse element 61 which has a flat shape formed by punching a conductive metal plate material, and which has a bent part 61*a*, which is bent afterwards, is manufactured. Next, as shown in FIG. 14, the insulative resin part 70 is formed with insertion molding by using the flat-shaped fuse element 61 as an insertion component. Next, the bolts 67 are press fitted into the parts of the insulative resin part 70 at the first and the second terminal connecting parts 63 and 64. Next, the fuse element 61 is bent at a nearly right angle at the bent part 61*a*. Thus, the manufacture of the fuse unit 60 shown in FIG. 12 is completed.

According to the above-mentioned conventional example, since the fuse unit 60 is directly attached to the battery 50 and the fuse unit 60 can be arranged along the upper surface 50*a* and the side surface 50*b* of the battery 50, the fuse unit 60 can be installed around the battery.

A fuse unit which is almost the same as the above-mentioned conventional example is disclosed in a PTL 1.

CITATION LIST

[Patent Literature]

[PTL 1] Japan Patent Publication No. 2001-297683

SUMMARY OF INVENTION

Technical Problem

However, in the fuse unit 60 of the above-mentioned conventional example, as shown in FIG. 11, since the second terminal fusible parts 66, the second terminal connecting parts 64 and the electric wire holding parts 70*b* are arranged in this order in series on the side surface 50*b* of the battery 50, the dimension L4 in the side surface direction of the battery 50 (arrow Y direction) is large, and it is necessary to have a large setting space from the upper surface 50*a* of the battery 50 to the bottom of the side surface 50*b*.

Since the second terminal connecting parts 64 are located below the upper surface 50*a* of the battery 50, it is difficult to connect the terminals (not shown in the figures).

Thus, the invention is made in order to solve the above-mentioned problems, and the purpose of the invention is to provide a fuse unit which can be installed even when only a small setting space can be secured from the upper surface of a battery toward the bottom of the side surface, and which makes the connecting of terminals become easy.

Solution to Problem

The above purpose of the invention is achieved with the following structures.

(1) A fuse unit, comprising:

a fuse element which is made of conductive metal material, and which includes a power supply connecting part fixed to a battery post of a battery so as to receive power supply and arranged along an upper surface of the battery, a terminal connecting part to which a terminal is connected, and a fusible part provided between the power supply connecting part and the terminal connecting part; and an insulative resin part that is arranged on outer surface of the fuse element, wherein the fuse element is bent upwards at a position between the power supply connecting part and the terminal connecting part, and the terminal connecting part is arranged at a position above the upper surface of the battery and along a side surface direction of the battery.

(2) The fuse unit according to the above (1), wherein the fuse element is bent at a position between the fusible part and the terminal connecting part.

(3) The fuse unit according to the above (1) or (2), wherein the insulative resin part has an electric wire holding part at a position below the terminal connecting part.

(4) The fuse unit according to any one of the above (1) to (3), wherein a plurality of fusible parts and terminal connecting parts are provided, all the fusible parts are arranged at parallel positions of the power supply connecting part, respectively, and the fuse element is bent at positions between the fusible parts and the terminal connecting parts.

DESCRIPTION OF EMBODIMENTS

Below, one embodiment of the invention is described based on the figures.

Figure 1:
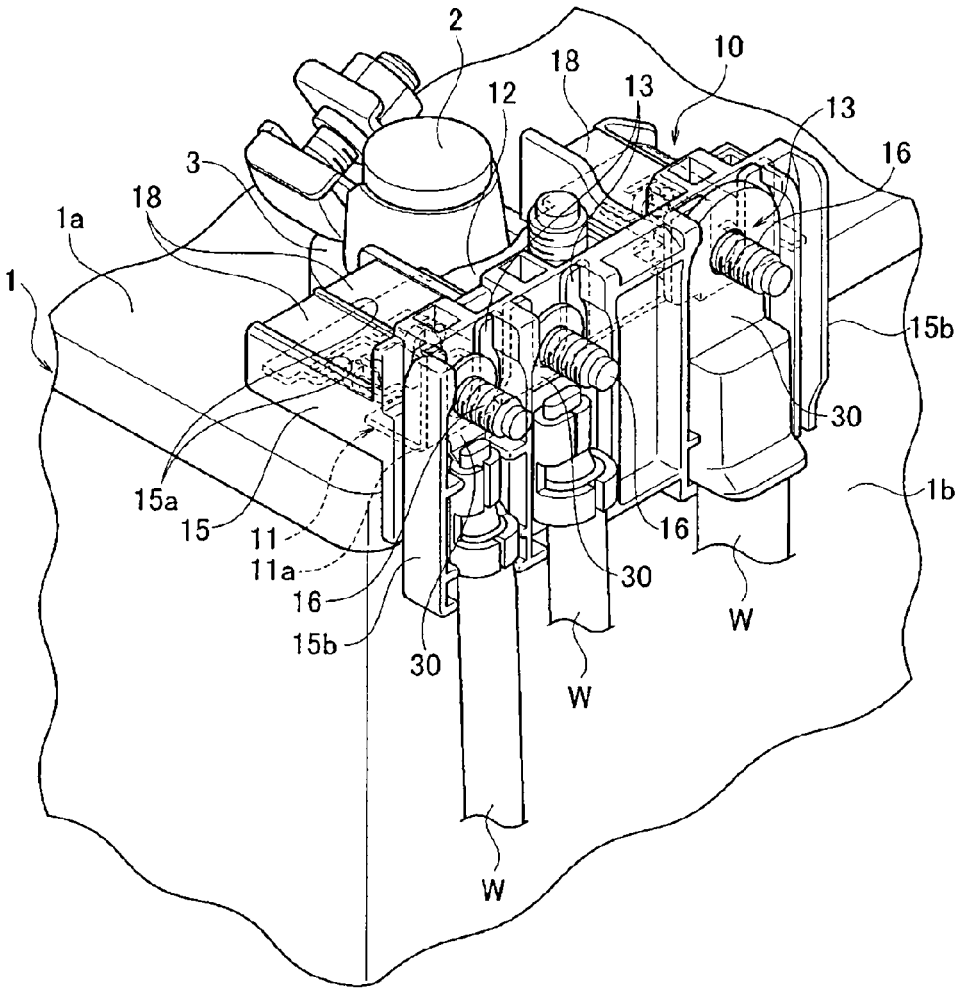
FIG. 1 shows one embodiment of the invention and is a perspective view of a fuse unit which is directly attached to a battery.
Figure 2:
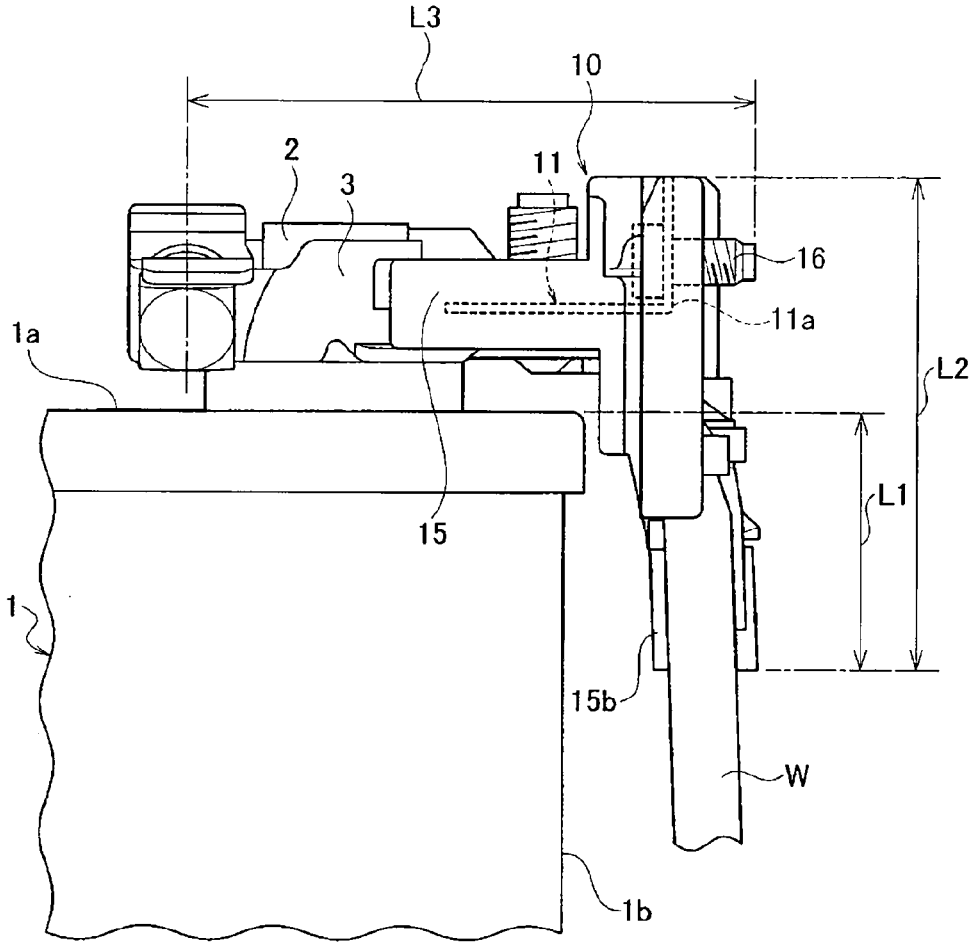
FIG. 2 is a side view of the fuse unit shown in FIG. 1.
Figure 3:
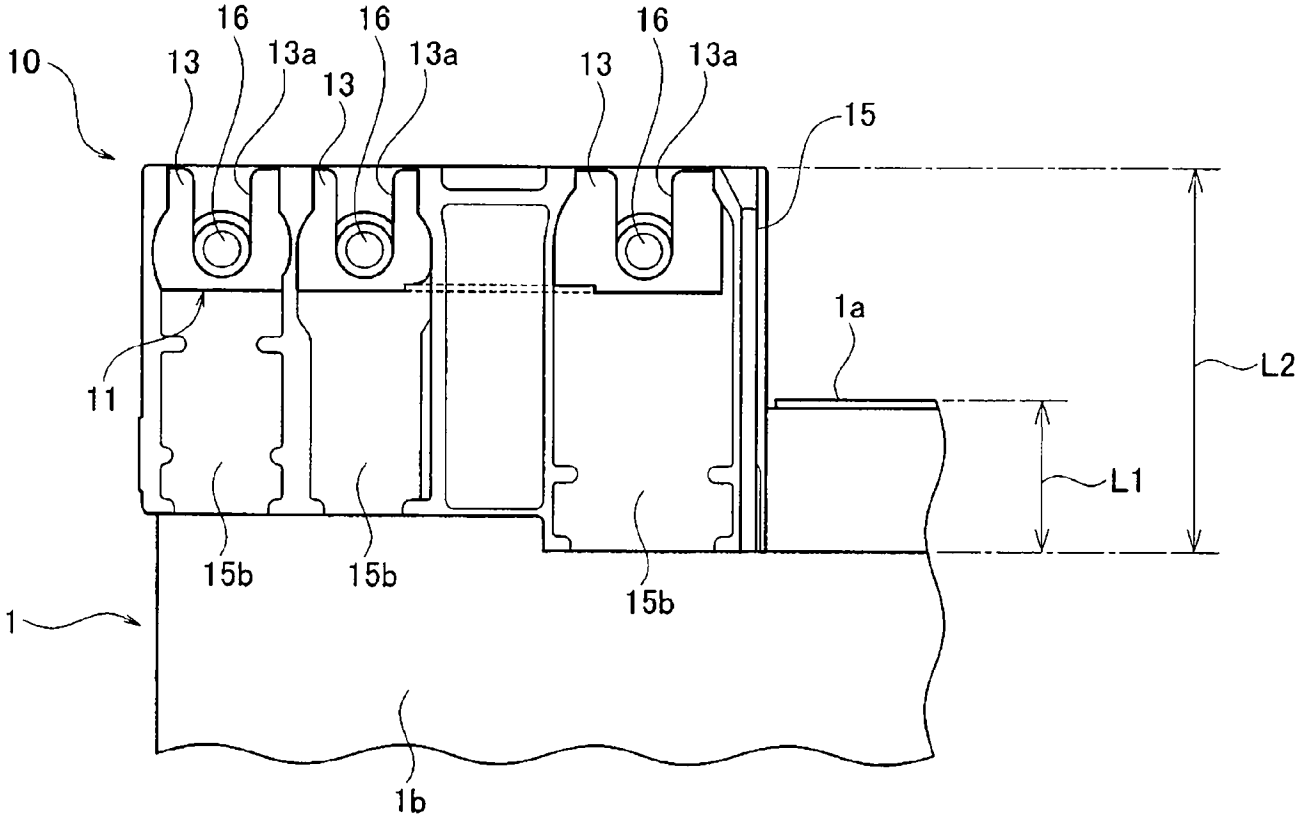
FIG. 3 shows the embodiment of the invention and is a front view of the fuse unit which is directly attached to the battery.
Figure 4:
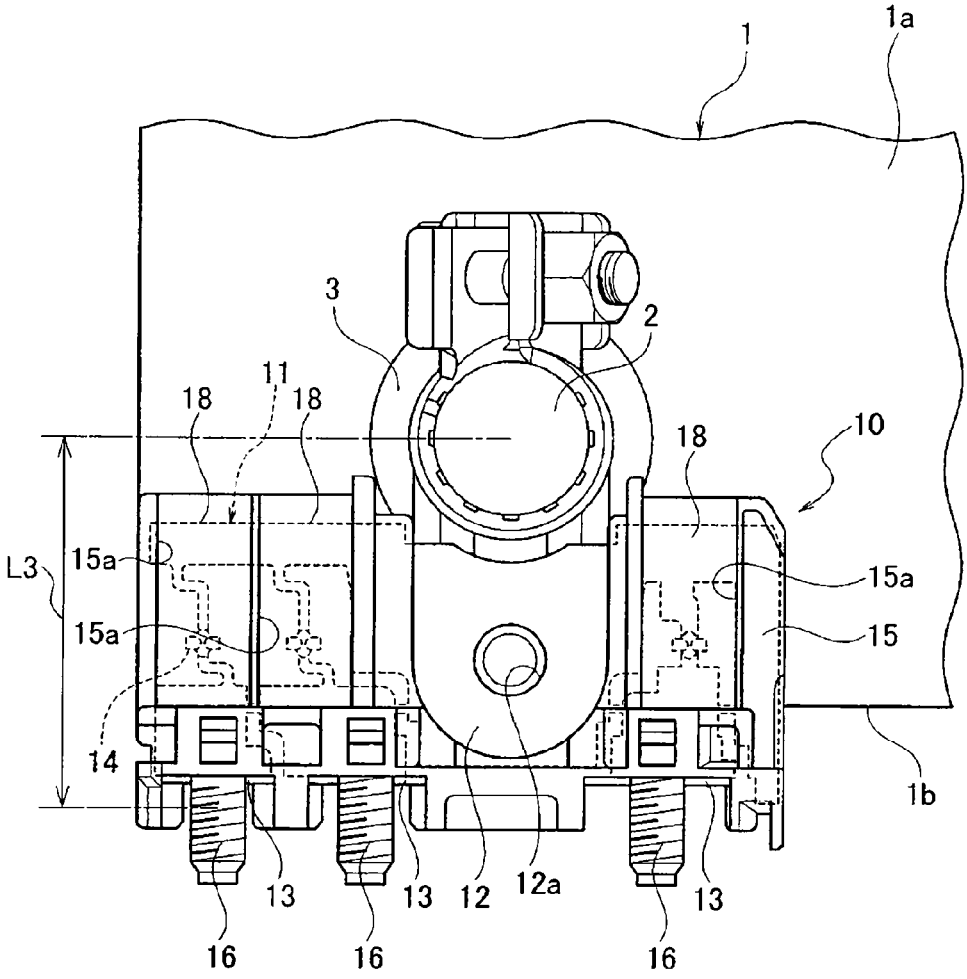
FIG. 4 shows the embodiment of the invention and is a top view of the fuse unit which is directly attached to the battery.
Figure 5:
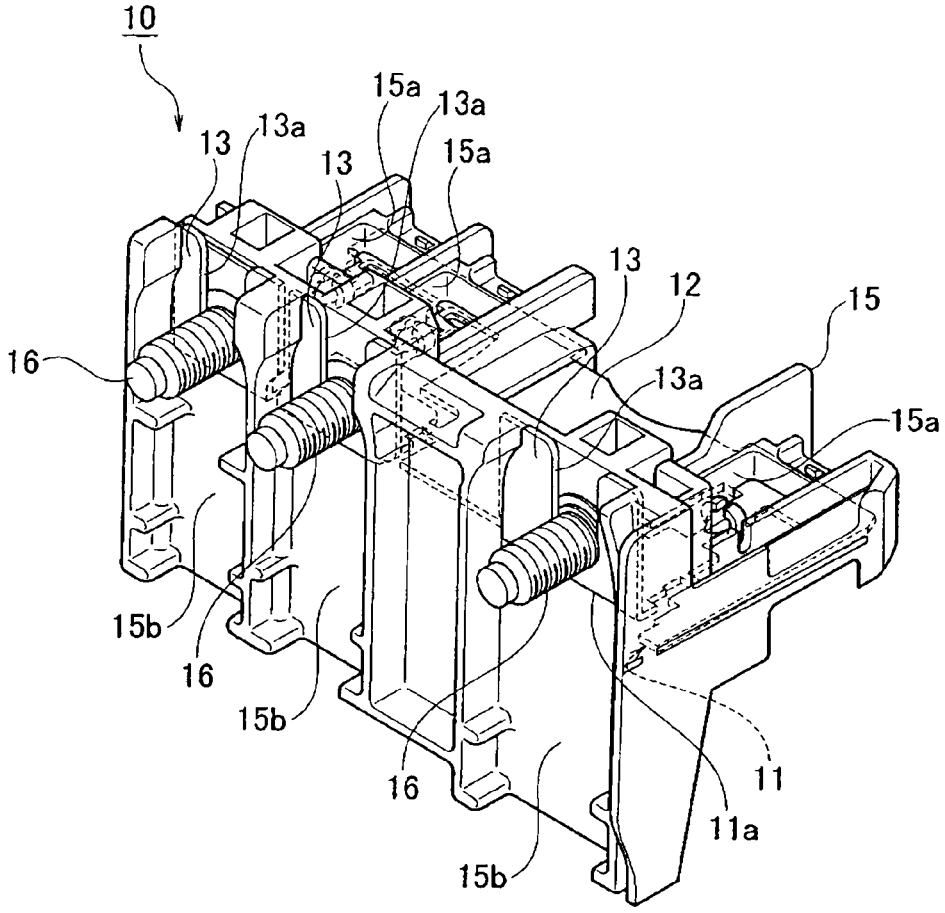
FIG. 5 shows the embodiment of the invention and is a perspective view of the fuse unit.
Figure 6:
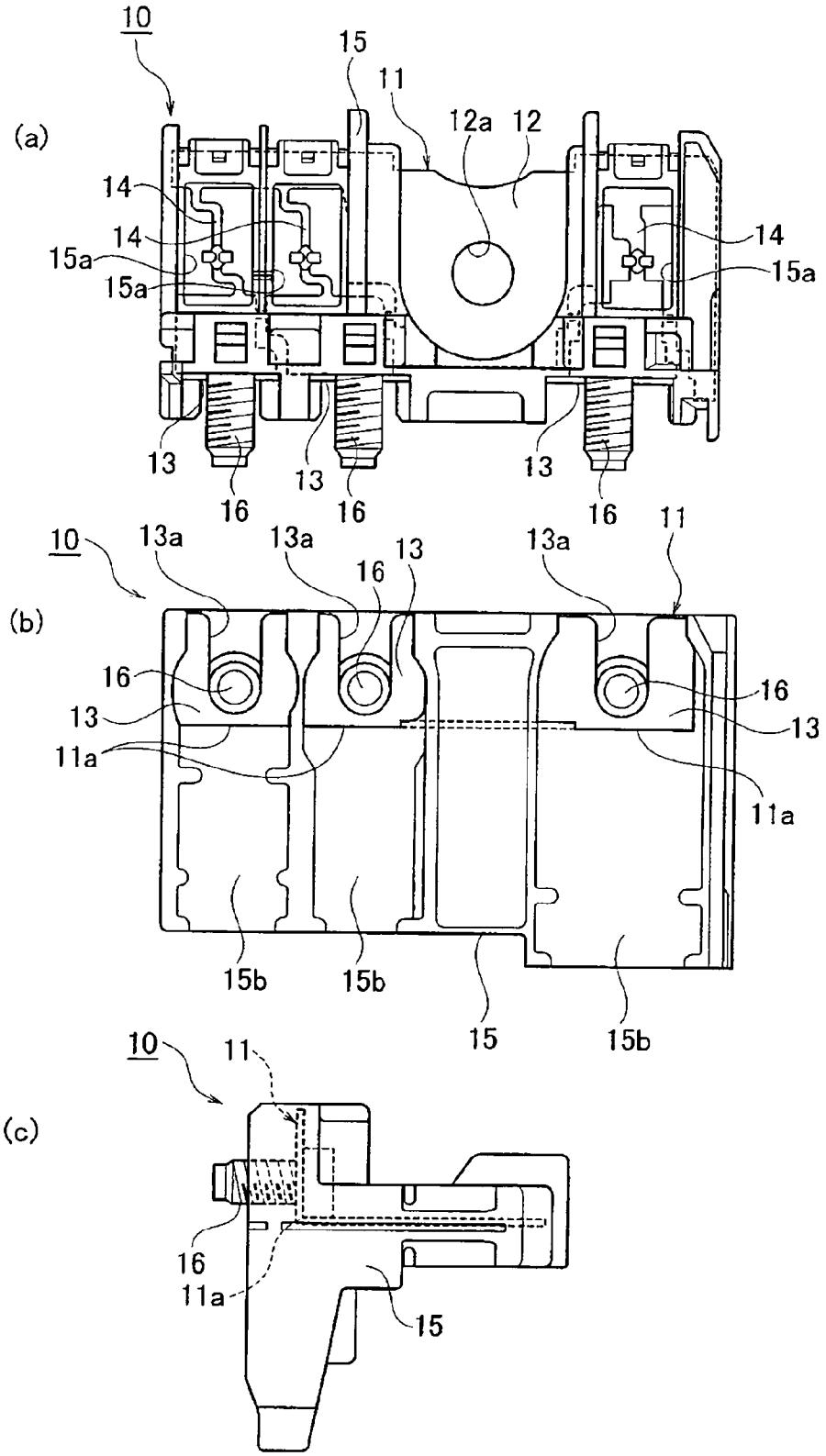
FIG. 6 shows the embodiment of the invention, in which FIG. 6(*a*) is a top view of the fuse unit shown in FIG. 5, FIG. 6(*b*) is a front view of the fuse unit shown in FIG. 5, and FIG. 6(*c*) is a side view of the fuse unit shown in FIG. 5.
Figure 7:
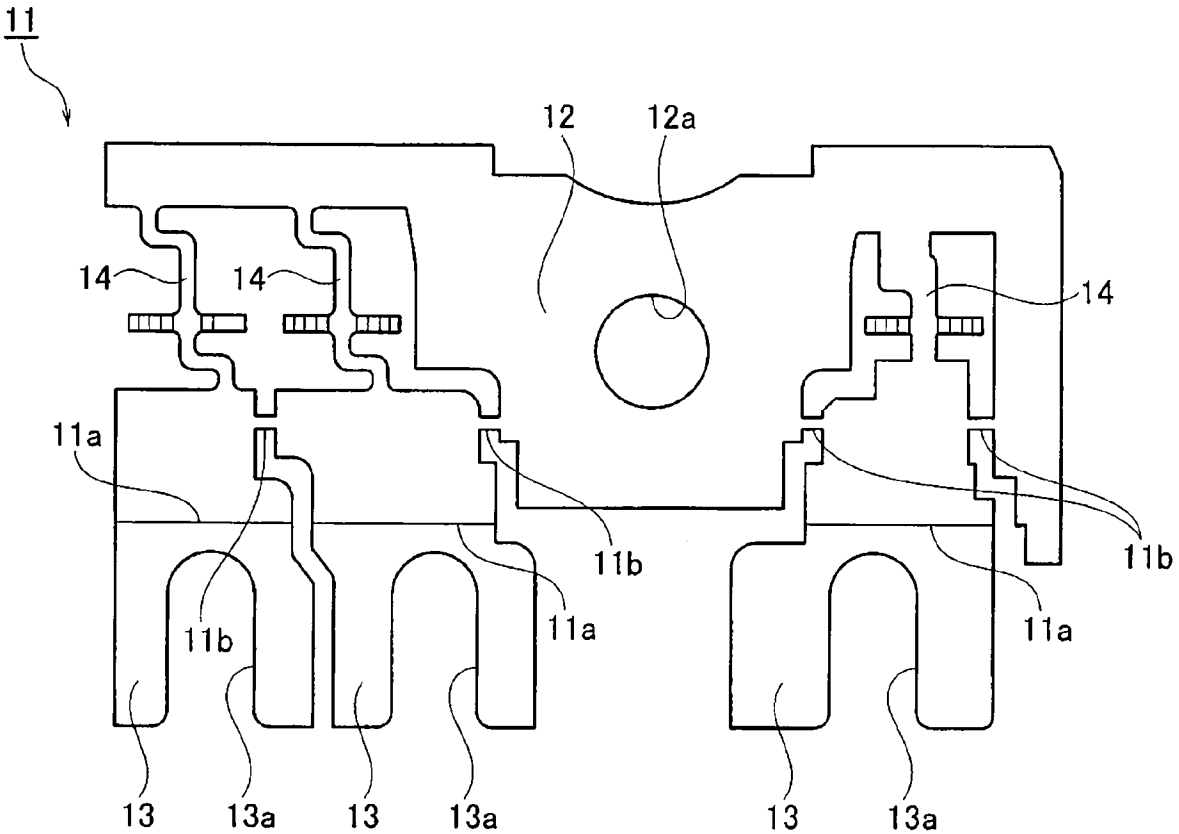
FIG. 7 shows the embodiment of the invention and is a top view of a fuse element before the fuse element is bent.
Figure 8:
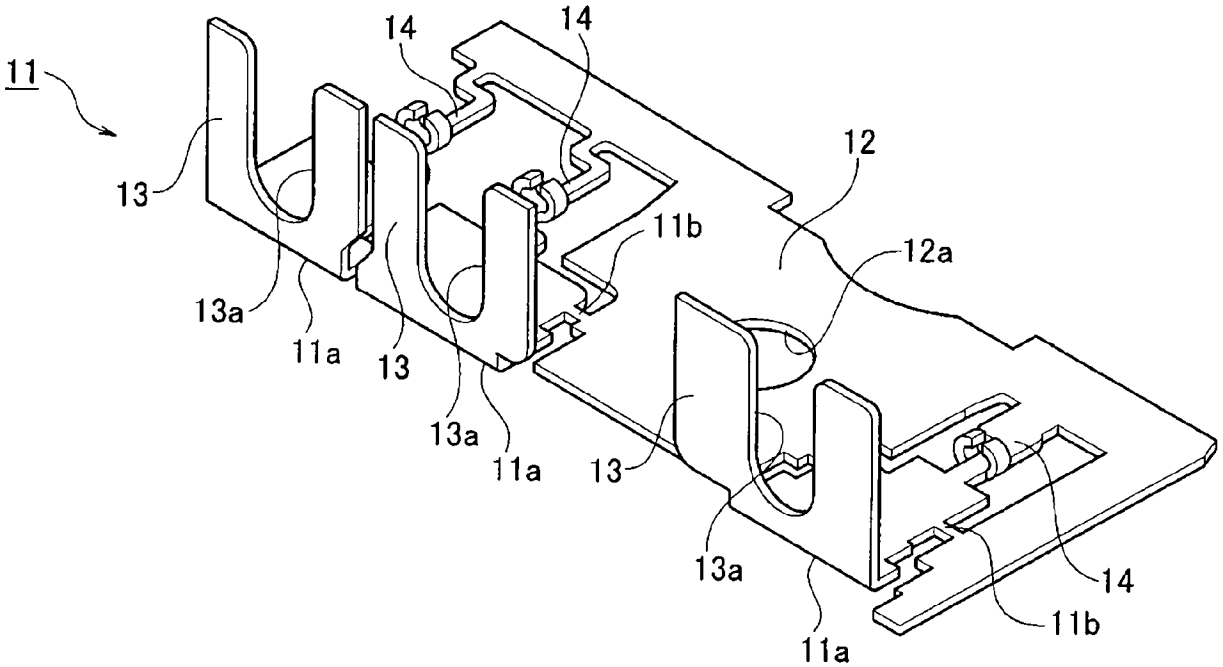
FIG. 8 is a perspective view of the fuse element shown in FIG. 7 after the fuse element is bent.
Figure 9:
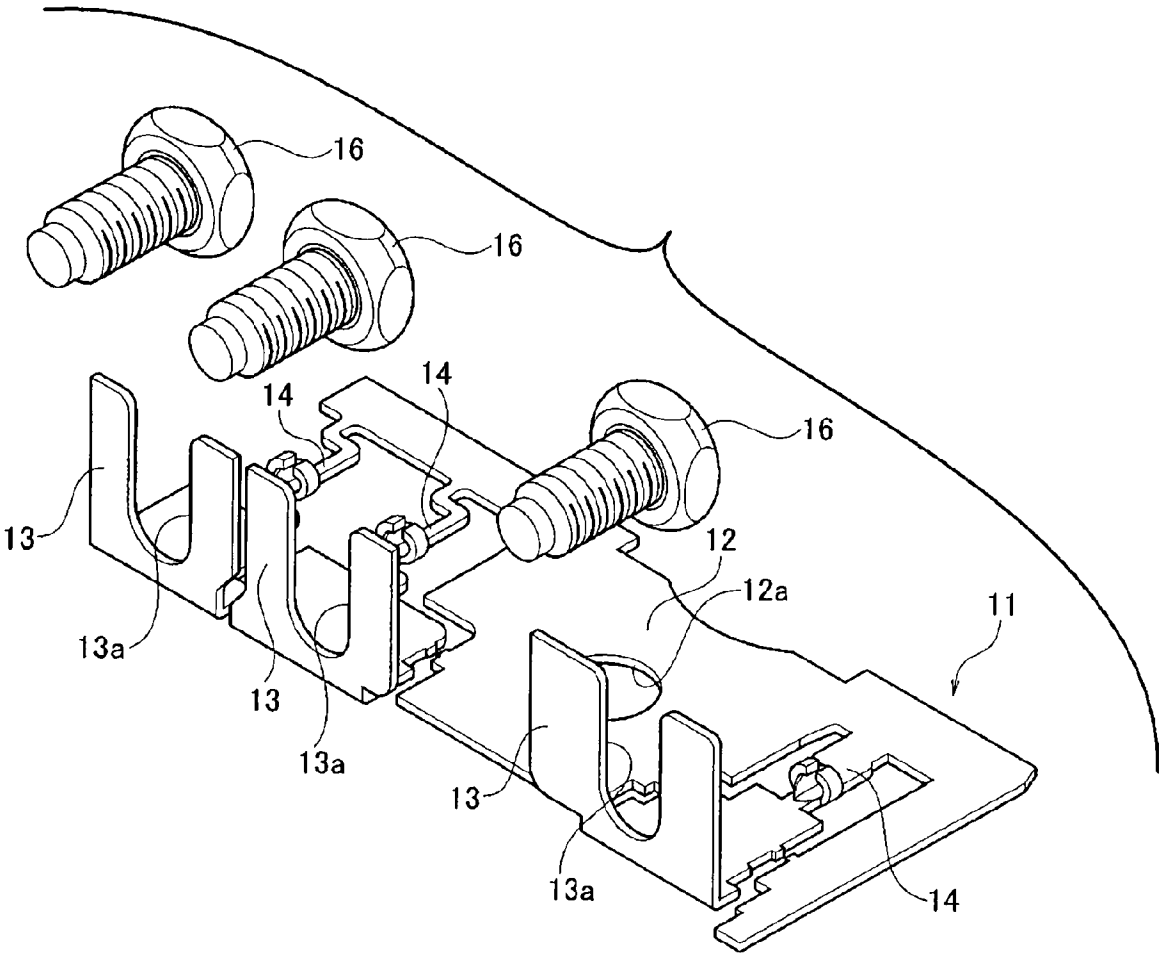
FIG. 9 is a perspective view which shows a process in which bolts are set over the fuse element shown in FIG. 8.
Figure 10:
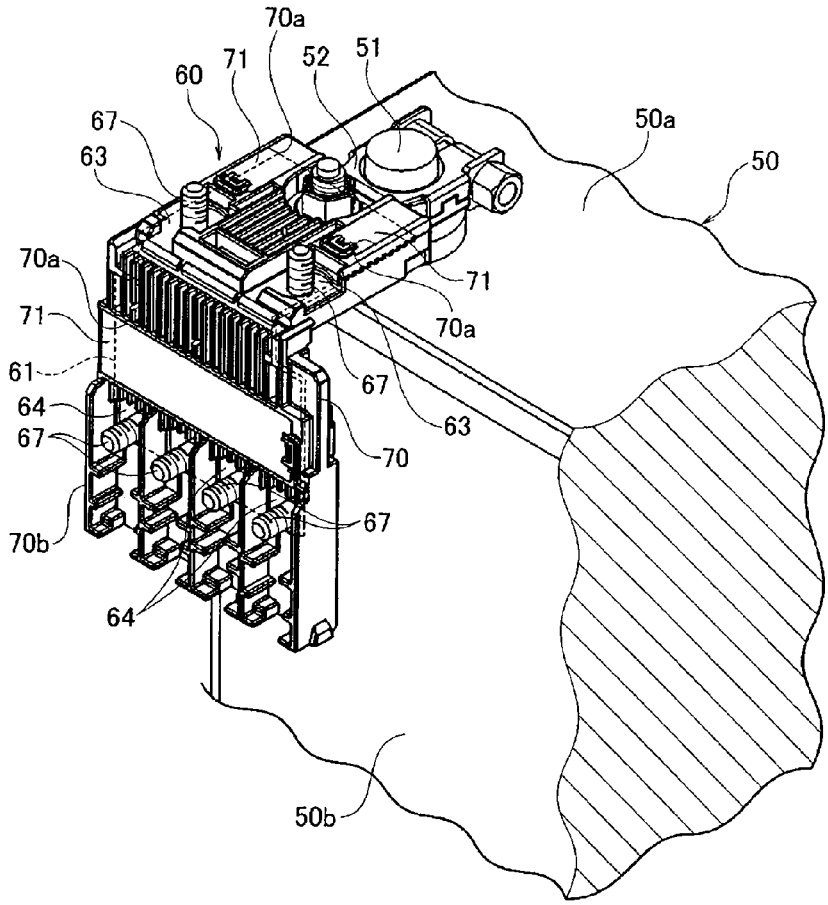
Fig. 10 PRIOR ART
FIG. 10 shows a conventional example and is a perspective view of a fuse unit which is directly attached to a battery.
Figure 11:
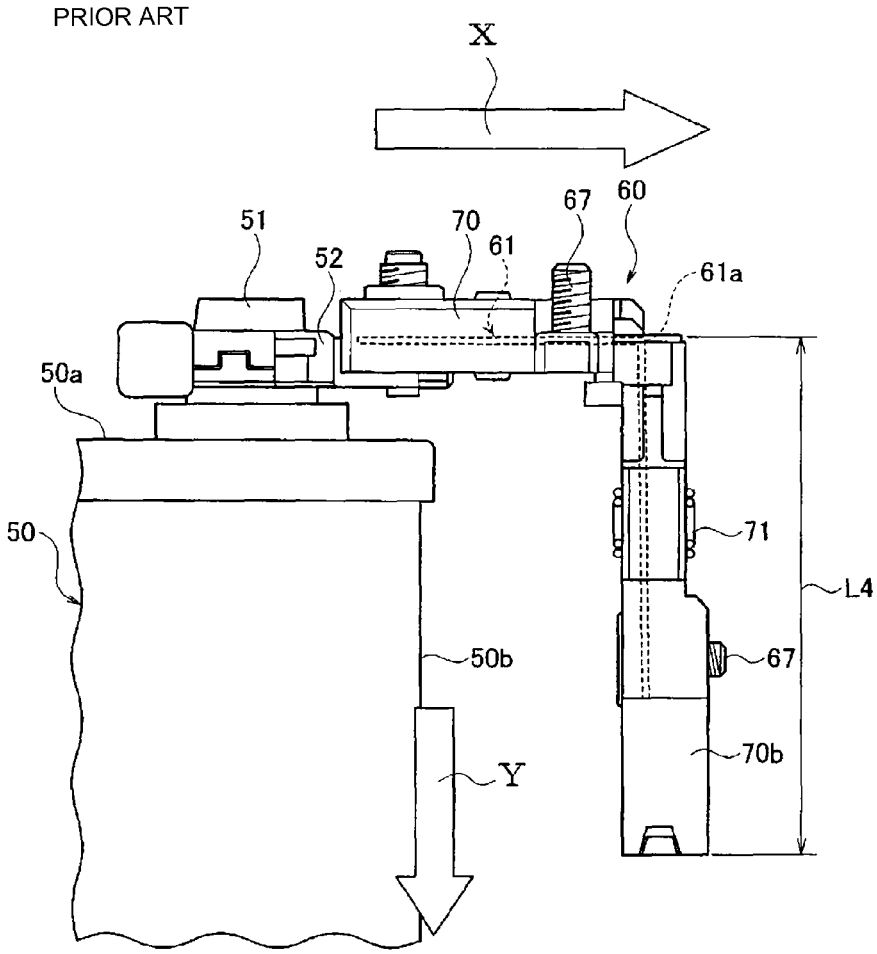
Fig. 11 PRIOR ART
FIG. 11 is a side view of the fuse unit shown in FIG. 10.
Figure 12:
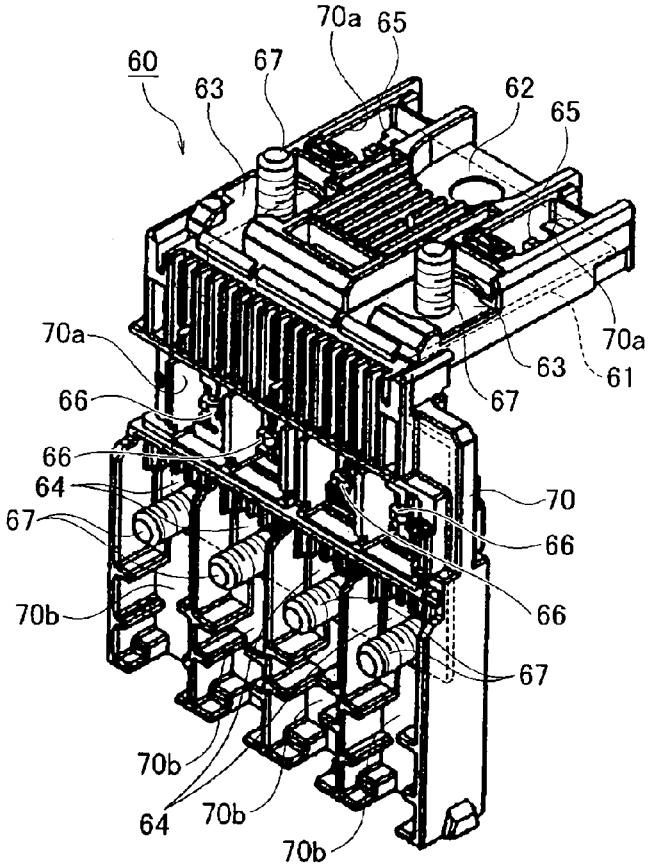
Fig. 12 PRIOR ART
FIG. 12 is a perspective view of the fuse unit of the conventional example.
Figure 13:
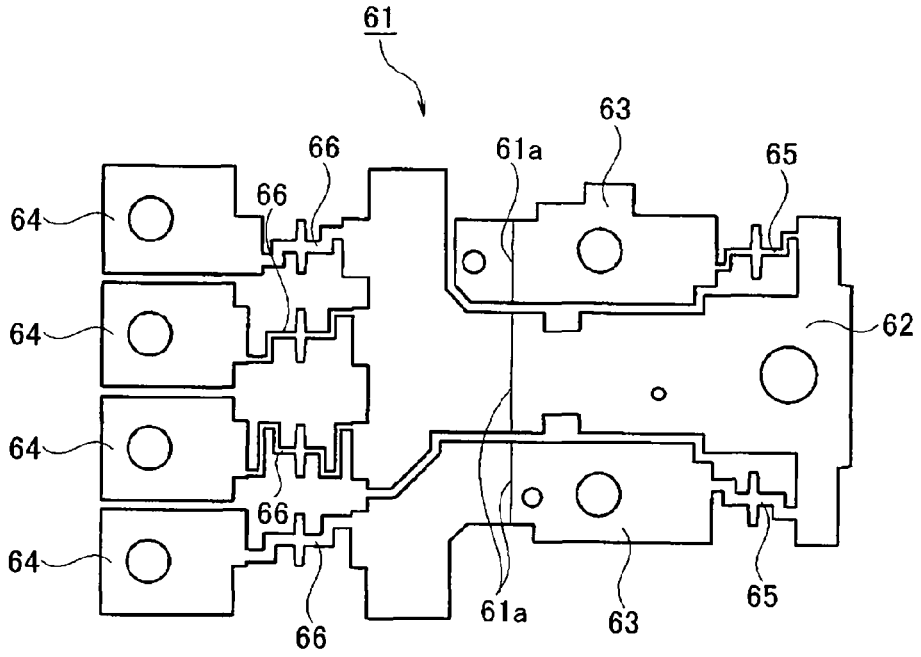
FIG. 13 shows the conventional example and is a top view of a fuse element before the fuse element is bent.
Figure 14:
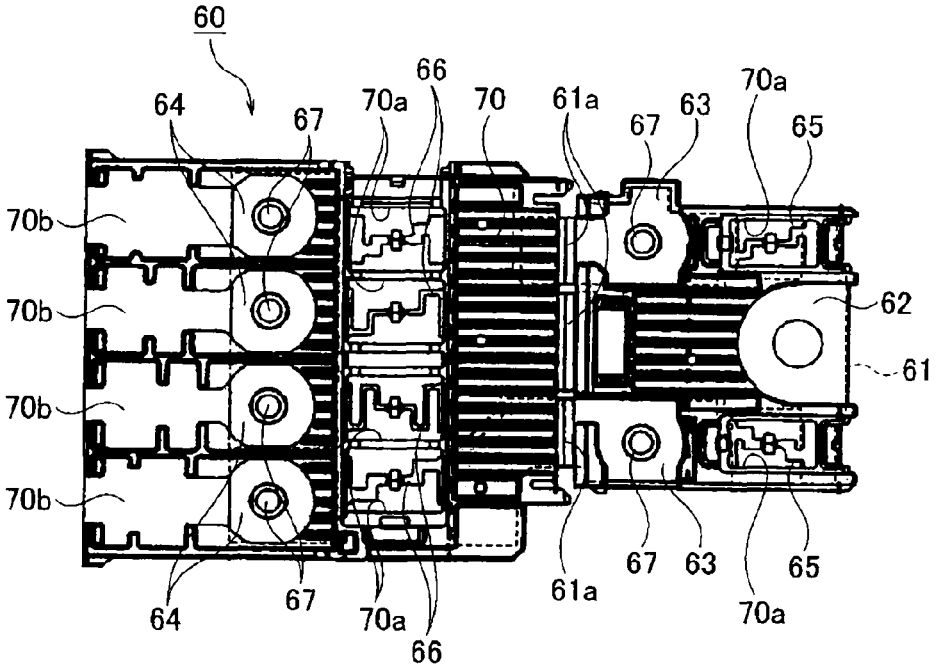
FIG. 14 shows the conventional example and is a top view which shows that an insulative resin part is formed with insertion molding at the fuse element shown in FIG. 13.

FIGS. 1 to 9 show the embodiment of the invention, in which FIG. 1 is a perspective view of a fuse unit 10 which is directly attached to a battery 1, FIG. 2 is a side view of the fuse unit 10 shown in FIG. 1, FIG. 3 is a front view of the fuse unit 10 which is directly attached to the battery 1, FIG. 4 is a top view of the fuse unit 10 which is directly attached to the battery 1, FIG. 5 is a perspective view of the fuse unit 10, FIG. 6(*a*) is a top view of the fuse unit 10 shown in FIG. 5, FIG. 6(*b*) is a front view of the fuse unit 10 shown in FIG. 5, FIG. 6(*c*) is a side view of the fuse unit 10 shown in FIG. 5, FIG. 7 is a top view of a fuse element 11 before the fuse element 11 is bent, FIG. 8 is a perspective view of the fuse element 11 shown in FIG. 7 after the fuse element 11 is bent, and FIG. 9 is a perspective view which shows a process in which bolts 16 are set over the fuse element 11 shown in FIG. 8.

As shown in FIGS. 1 to 6, a battery post 2 is protruded from the upper surface 1*a* of the battery 1 which is loaded in a vehicle. The fuse unit 10 is fixed to the battery post 2 via a battery connecting terminal 3.

The fuse unit 10 is provided with the fuse element 11 and an insulative resin part 15 which is provided outside the fuse element 11 with insertion molding.

The fuse element 11 is formed of a busbar which is a conductive metal plate. The fuse element 11 has a power supply connecting part 12 which is fixed to the battery post 2 via the battery connecting terminal 3, three terminal connecting parts 13 to which terminals 30 are respectively connected, three fusible parts 14 which respectively intervene between the power supply connecting part 12 and the terminal connecting parts 13.

The power supply connecting part 12 has a bolt insertion through hole 12*a*. The battery connecting terminal 3 is fixed to the power supply connecting part 12 using the bolt insertion through hole 12*a*. The power supply connecting part 12 receives power from the battery 1 via the battery connecting terminal 3.

The three terminal connecting parts 13 are arranged at positions in parallel with each other (refer to FIG. 3). Each of the terminal connecting parts 13 has a U-shaped groove 13*a* which opens upwards. The bolts 16 are inserted into the U-shaped grooves 13*a*, and the inserted bolts 16 are fixed with the insulative resin part 15. The terminals 30 which are inserted into the bolts 16 are fixed by being fastened with nuts (not shown in the figures). The terminal connecting parts 13 are supplied power from the power supply connecting part 12 respectively via the fusible parts 14. If an over-current flows, the fusible part 14 will melt and the power supply will be cut off.

The three fusible parts 14 are arranged at parallel positions of the power supply connecting part 12, respectively (refer to FIG. 4). Each of the fusible parts 14 includes a narrow part of a prescribed dimension and a low melting point metal which is fixed to the narrow part by being fastened.

The fuse element 11 has a bent part 11*a* at a position between the three fusible parts 14 and the three terminal connecting parts 13, and is bent upwards at a nearly right angle at the bent part 11*a*. Therefore, the power supply connecting part 12 and the three fusible parts 14 are arranged along the upper surface 1*a* of the battery 1, and the three terminal connecting parts 13 are arranged at positions above the upper surface 1*a* of the battery 1, and along the side surface direction of the battery 1.

The insulative resin part 15 covers those parts other than the power supply connecting part 12, the terminal connecting parts 13, and the fusible parts 14. The power supply connecting part 12 and the terminal connecting parts 13 are exposed for the conduction between terminals, and the connection of terminals. Each of the fusible parts 14 is exposed so that whether the fusible parts 14 melt can be viewed. Fusible part windows 15*a* are formed in the insulative resin part 15 so that the fusible parts 14 are enclosed. Each of the fusible part windows 15*a* is closed by a transparent fusible part cover 18. In the insulative resin part 15, electric wire holding parts 15*b* are formed at positions below the terminal connecting parts 13, respectively.

Next, a method of manufacturing the fuse unit 10 of the above-mentioned structure is explained briefly.

First, as shown in FIG. 7, the fuse element 11 which has a flat shape formed by punching a conductive metal plate material to have a predetermined shape, and which has a bent part 11*a*, which is bent afterwards, is manufactured. Connecting bridges 11*b* which will be cut later are provided at proper positions of the fuse element 11. The strength of the fuse element 11 is secured with the connecting bridges 11*b*.

Next, as shown in FIG. 8, the fuse element 11 is bent at a nearly right angle at the bent part 11*a*. Then, the connecting bridges 11*b* are cut.

Next, as shown in FIG. 9, the bolts 16 are respectively inserted into the U-shaped grooves 13*a* of the three terminal connecting parts 13, which face upwards relative to the fuse element 11.

Next, the fuse element 11 and the three bolts 16 are used as insertion components, and the insulative resin part 15 is formed with insertion molding outside the fuse element 11. Thus, the manufacture of the fuse unit 10 shown in FIGS. 5 to 6(*c*) is completed.

Thus, the fuse unit 10 so manufactured is fixed to the battery post 2 via the battery connecting terminal 3. The terminals 30 are connected to the terminal connecting parts 13, respectively. Electric wires W which are connected to the terminals 30 are accommodated in the electric wire holding parts 15*b*. The fusible part windows 15*a* are closed by the fusible part covers 18.

As mentioned above, in the fuse unit 10 according to the embodiment, the fuse element 11 is bent upwards at the position between the fusible parts 14 and the terminal connecting parts 13, and the terminal connecting parts 13 are located above the upper surface 1*a* of the battery 1, and arranged along the side surface direction of the battery 1. Thus, the terminal connecting parts 13 are arranged upwards from the upper surface 1*a* of the battery 1, and the dimension L1 (shown in FIGS. 2 and 3) which extends downwards from the upper surface of the battery 1 along the side surface direction can be reduced. Even when a big setting space at the bottom of the side surface 1*b* of the battery 1 cannot be secured, the fuse unit 10 can be installed. Therefore, various wiring arrangements around the battery 1 can be supported. Specifically, the dimension L1 from the upper surface 1*a* of the battery 1 in the fuse unit 10 to the bottom of the side surface becomes a short dimension which is roughly the dimension of the electric wire holding parts 15*b*.

Since the terminal connecting parts 13 are arranged upwards from the upper surface 1*a* of the battery 1, it is easy to connect the terminals 30. That is, since the tool space at the time of connecting the terminals 30 is located above the upper surface 1*a* of the battery 1, it is easy to carry out the connection.

Since the fuse element 11 is bent at the position between the fusible parts 14 and the terminal connecting parts 13 and the fusible parts 14 are arranged on the upper surface 1*a* of the battery 1, compared with the conventional example, it is possible to reduce the dimension L2 in the side surface direction of the battery 1 due to the dimension of the fusible parts 14.

Since the insulative resin part 15 has the electric wire holding parts 15*b* at the positions below the terminal connecting parts 13, the electric wires W of the terminals 30 which are fixed with the terminal connecting parts 13 can be prevented from waving due to the vibration of the vehicle as much as possible.

Two or more fusible parts 14 and terminal connecting parts 13 are provided, all the fusible parts 14 are arranged at the parallel positions of the power supply connecting part 12, respectively, and the fuse element 11 is bent at the positions between the fusible parts 14 and the terminal connecting parts 13. Thus, as shown in FIGS. 2 and 4, the dimension L3 in the overhang direction (direction protruded from the side surface of the battery) can be reduced. The dimension L3 in the overhang direction is based on the battery post 2.

Although the fuse unit 10 is fixed to the battery post 2 via the battery connecting terminal 3 in the embodiment, the fuse unit 10 may have a structure to be fixed to the battery post 2 without the battery connecting terminal 3.

According to the embodiment, the fuse unit 10 has three terminal connecting parts 13 and three fusible parts 14, respectively. However, it is also possible that the number of the terminal connecting parts 13 and the fusible parts 14 may be one, two or more, respectively, and the number of the terminal connecting parts 13 may be different from that of the fusible parts 14.

Although the present invention is described in detail with reference to the embodiments, it is apparent that various modifications and amendments may be made by those skilled in the art without departing from the spirit and scope of the invention.

This application is based on the Japanese patent application (patent application 2010-027422) filed on Feb. 10, 2010, whose content is incorporated herein by reference.

INDUSTRIAL APPLICABILITY

According to the fuse unit of the invention, since the terminal connecting parts are arranged above the upper surface of the battery, and the dimension that extends downwards from the upper surface of the battery along the side surface direction of the battery can be reduced, even when only a small setting space from the upper surface of the battery towards the bottom of the side surface of the battery can be secured, the fuse unit can be installed. Since the terminal connecting parts are arranged upwards from the upper surface of the battery, it is easy to connect the terminals.

REFERENCE SIGNS LIST

1 battery
1*a* upper surface
1*b* side surface
2 battery post
10 fuse unit
11 fuse element
12 power supply connecting part
13 terminal connecting part
14 fusible part
15 insulative resin part
30 terminal

The invention claimed is:

1. A fuse unit, comprising:

a fuse element which is made of conductive metal material, and which includes a power supply connecting part fixed to a battery post of a battery so as to receive power supply and arranged along an upper surface of the battery, a terminal connecting part to which a terminal is connected, and a fusible part provided between the power supply connecting part and the terminal connecting part; and an insulative resin part that is arranged on outer surface of the fuse element, wherein the fuse element is bent upwards at a position between the power supply connecting part and the terminal connecting part, and the terminal connecting part is arranged at a position above the upper surface of the battery and along a side surface direction of the battery.

2. The fuse unit according to claim 1, wherein the fuse element is bent at a position between the fusible part and the terminal connecting part.

3. The fuse unit according to claim 1, wherein the insulative resin part has an electric wire holding part at a position below the terminal connecting part.

4. The fuse unit according to claim 1, wherein a plurality of fusible parts and terminal connecting parts are provided, all the fusible parts are arranged at parallel positions of the power supply connecting part, respectively, and the fuse element is bent at positions between the fusible parts and the terminal connecting parts.

* * * * *